United States Patent [19]

Schmidt, III

[11] Patent Number: 4,619,532

[45] Date of Patent: Oct. 28, 1986

[54] SHAKER FOR PAINT CONTAINERS

[75] Inventor: John W. Schmidt, III, Safety Harbor, Fla.

[73] Assignee: Everett Douglas Hougen, Flint, Mich.

[21] Appl. No.: 676,429

[22] Filed: Nov. 29, 1984

[51] Int. Cl.[4] ..... B01F 11/00

[52] U.S. Cl. ..... 366/110; 366/128; 366/605

[58] Field of Search ..... 366/605, 110, 111, 112, 366/114, 115, 128, 209; 241/175; 51/163.1, 163.2; 248/623, 638

[56] References Cited

U.S. PATENT DOCUMENTS

| | | | |
|---|---|---|---|
| 2,353,492 | 7/1944 | O'Connor | 366/112 |
| 2,636,719 | 4/1953 | O'Connor | 366/114 X |
| 3,265,366 | 8/1966 | Warner | 366/112 |
| 3,415,495 | 12/1968 | Grubelic | 366/605 X |
| 3,448,964 | 6/1969 | Wickes | 366/112 |
| 3,912,207 | 10/1975 | Gauer | 248/638 X |
| 3,943,668 | 3/1976 | McKibben | 51/163.2 |

FOREIGN PATENT DOCUMENTS

| | | | |
|---|---|---|---|
| 210693 | 4/1968 | U.S.S.R. | 51/163 R |

*Primary Examiner*—Philip R. Coe

*Attorney, Agent, or Firm*—Cullen, Sloman, Cantor, Grauer, Scott & Rutherford

[57] ABSTRACT

A paint shaker has a base on which is mounted a motor support plate by four vertical compression springs. A vertically oriented electric motor depends from the motor mounting plate and has an eccentric flyweight secured to its output shaft above the motor mounting plate. A container support plate is mounted on the motor support plate by four additional vertical compression springs that are stiffer than the lower springs. A frame structure is mounted on the container support plate to enable clamping one or more containers thereon.

23 Claims, 16 Drawing Figures

FIG. 6
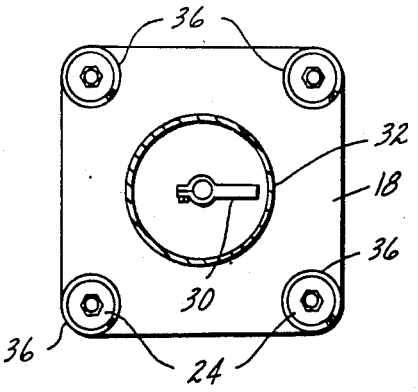
FIG. 7
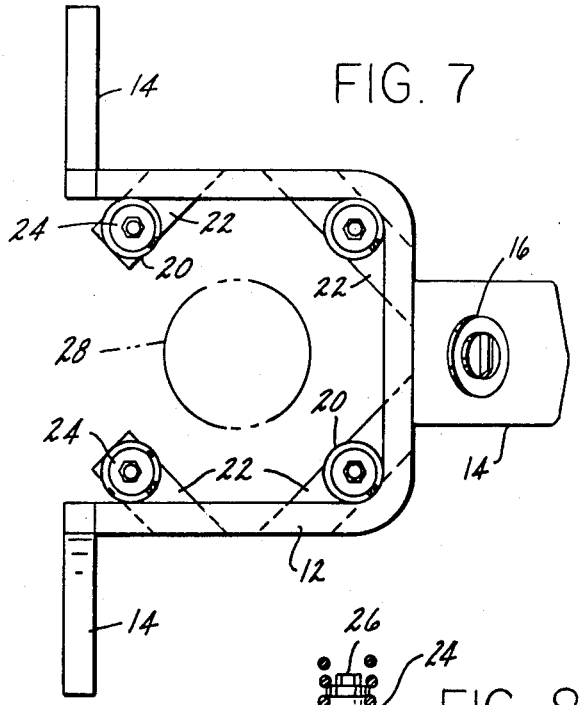
FIG. 10
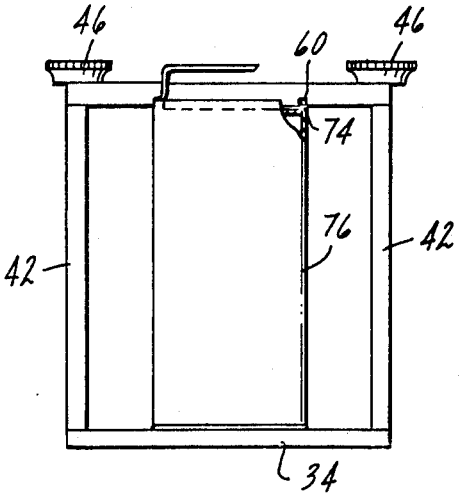
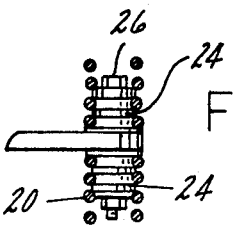
FIG. 8
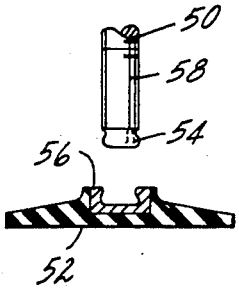
FIG. 9
FIG. 11
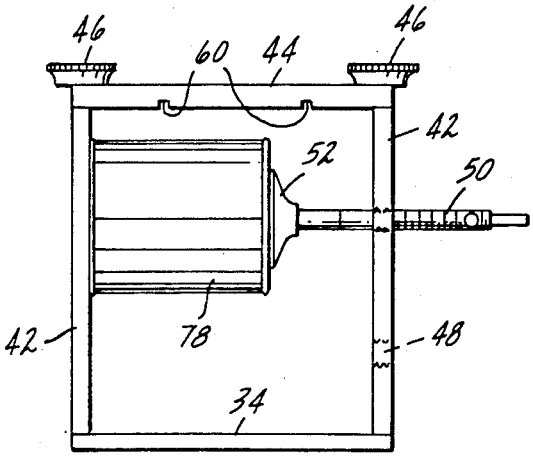
FIG. 12
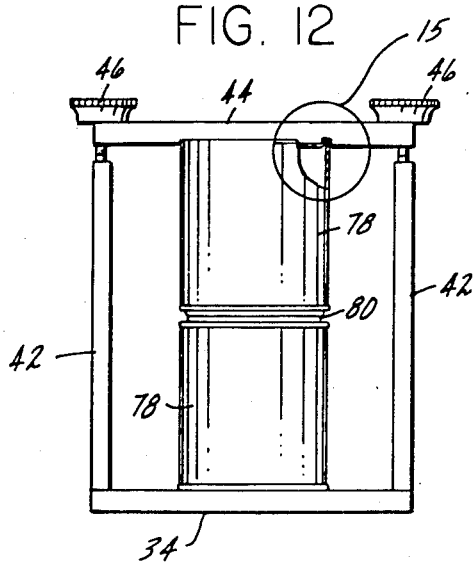

SHAKER FOR PAINT CONTAINERS

This invention relates to a shaker apparatus and, more specifically, to a device used to shake or agitate containers of paint and other emulsions.

The more solid phase of many emulsions, including paint, "settle" when stored for lengthy periods of time. Before using, these mixtures must be vigorously agitated to evenly disperse the more solid phase throughout the more liquid phase of the emulsion. Numerous types of shaker devices (hereinafter referred to generally as paint shakers) are extensively used at the present time. They fall generally into two types; those wherein the container and its supporting structure are vibrated by a crank-driven motor and those in which the container and its supporting structure are vibrated by means of a motor-driven eccentric weight.

Paint shakers of either type (especially those adapted for shaking gallon containers) are usually large, heavy and cumbersome. These disadvantages result primarily from the fact that a large motor is required to generate the shaking motion and the motion produced has a tendency to cause the whole shaker device to "walk" or "creep" on the surface on which it is supported. In paint shakers of the type wherein the vibratory or oscillating motion is produced by a motor-driven crank, a relatively large motor is required to initially overcome the inertia of the relatively heavy paint-filled container and its crank-driven supporting frame. Even with shakers of the type wherein the shaking action is produced by a motor-driven eccentric weight, unless a relatively heavy base frame is provided, the shaker device must be clamped or otherwise secured to its supporting surface to prevent it from "walking" or "creeping" when employed for shaking liquid-filled gallon containers.

The primary object of this invention is to provide a light-weight paint shaker of simple construction which is admirably suited for shaking liquid-filled gallon containers and which does not require it to be secured to a support surface.

Another object of this invention is to provide a paint shaker designed to readily accommodate containers which vary in size from as small as one pint to as large as one gallon.

A further object of this invention is to provide a paint shaker wherein a motor-driven eccentric weight imparts to the container an orbital and side-to-side motion which thoroughly mixes the contents of the container without entraining air therein.

A still further object of the invention is to provide a paint shaker which employs a motor for rotating a flyweight eccentric, a frame structure for supporting a container and a resilient suspension system for the motor and the frame structure which augments the violence of the action imparted to the container while insulating this action from the support base of the shaker device.

More specifically, the paint shaker of the present invention in its preferred form comprises a base on which a plate which supports a vertically oriented motor having an eccentric flyweight on its shaft is supported by four compression springs and a frame structure for supporting the container is in turn supported on a plate disposed above the motor and which, in turn, is supported on the motor-mounting plate by an additional four compression springs. The springs which support the motor are preferably designed to be more flexible than the springs which support the container support frame so that the violent agitation imparted to the container and its supporting frame are absorbed by the more flexible springs which support the motor on the shaker base.

Other objects, features and advantages of the present invention will become apparent from the following description and accompanying drawings, in which:

FIG. 6 is a sectional view along the line 6—6 in FIG. 2;

FIG. 7 is a sectional view along the line 7—7 in FIG. 2;

FIG. 8 is a fragmentary sectional view illustrating the manner in which the springs are secured to their respective supporting components;

FIG. 9 is a fragmentary sectional view illustrating the snap connection between the clamping screw and its pad;

FIG. 10 is a view illustrating the manner in which a standard rectangularly-shaped gallon container is adapted to be clamped on the shaker;

FIG. 11 illustrates the manner in which a standard cylindrical quart container is adapted to be clamped on the shaker;

FIG. 12 shows the manner in which two standard cylindrical quart containers are adapted to be clamped on the shaker;

Figure 1:
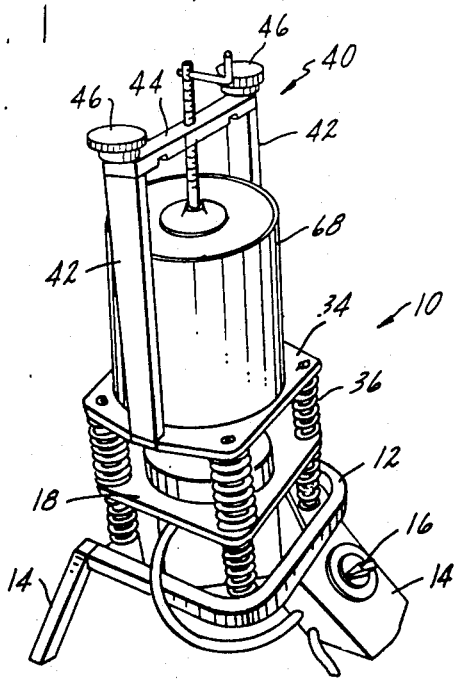
FIG. 1 is a perspective view of a paint shaker according to the present invention.
Figure 2:
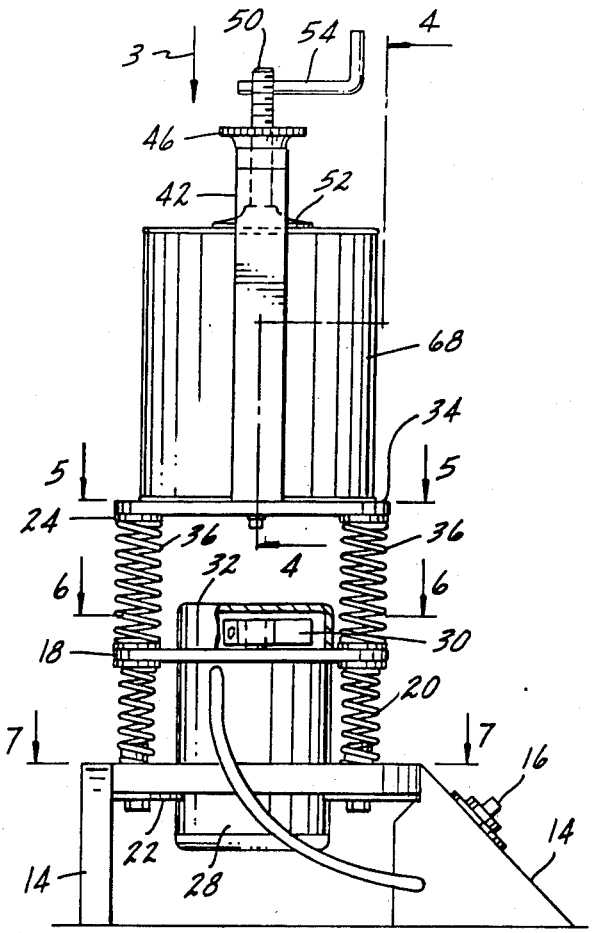
FIG. 2 is a side elevational view of the shaker.
Figure 3:
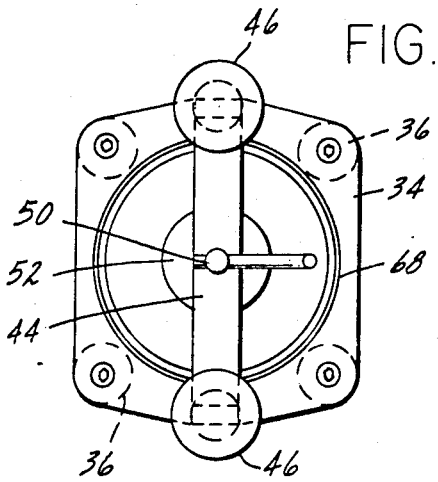
FIG. 3 is a top view of the shaker as viewed in the direction of the arrow 3 in FIG. 3.

Referring to FIG. 1, the paint shaker generally designated 10 includes a tubular generally U-shaped base frame 12 having three legs 14 extending downwardly and outwardly from the outer periphery thereof. On one of the legs there is mounted a timer switch 16. Base 12 supports a motor mounting plate 18 by means of four compression springs 20 which, at their lower ends, are mounted on gusset plates 22 welded at the corners of base 10. As shown in FIG. 8, the springs are connected to end mounts 24 secured to each plate by bolts 26. The mounts 24 are helically grooved for threaded engagement with the springs. This type of connection between the springs and the plates distributes the stress more evenly throughout the entire spring and increases spring life dramatically over arrangements where the springs are merely hooked at each end to supporting members. The mounts 24 also enable the spring rates to be adjusted since the springs can be threaded onto the mounts a greater or lesser amount which affects the amount of active wire in the spring.

A motor 28 is mounted on plate 18 and depends downwardly therefrom. Motor 28 is vertically oriented and has an eccentric flyweight 30 mounted on its output shaft for rotation in a generally horizontal plane, preferably above plate 18. A shroud 32 encloses the rotating flyweight 30. The motor is energized for any selected time period by means of the timer switch 16.

A container support plate 34 is supported on motor support plate 18 by four additional springs 36 which are positioned above the springs 20 and preferably in axial alignment therewith. The opposite ends of springs 36 are connected to the respective plates by spring mounts 24 of the type previously described. Springs 36 are preferably of larger diameter and of larger wire size and therefore stiffer than springs 20.

On plate 24 there is mounted a container clamping frame which is in the form of a U-shaped bracket 40 consisting of a pair of upright legs 42 having a cross bar 44 connected to their upper ends by threaded knobs 46. Cross bar 44 is provided with a threaded opening 48 at the center thereof for receiving a clamp screw 50 provided with a clamp pad 52 at one end and a handle 54 at its opposite end. As shown in FIG. 9, clamp pad 52 is adapted to be readily snapped into and out of engagement with the end 54 of screw 50 by means of a circumferentially resilient ring 56 on pad 52. Also as shown in FIG. 9, the lower portion 58 of screw 50 has the threads removed therefrom so that the leading end of the screw can be readily inserted through the opening 48 without threading and clamp pad 52 can be connected thereto by simply pressing it over the end 54 of the screw. One of the legs 42 is also provided with a pair of vertically spaced threaded openings 48 for engagement with similar clamping screws 50. Cross bar 44 has a pair of laterally spaced slots 60 on the underside thereof, the purpose of which will be hereinafter explained. Likewise, the container support plate 34 has a central opening 62 and a pair of concentric grooves 64,66 for receiving the lower projecting rim of standard quart and gallon paint containers, respectively.

Figure 4:
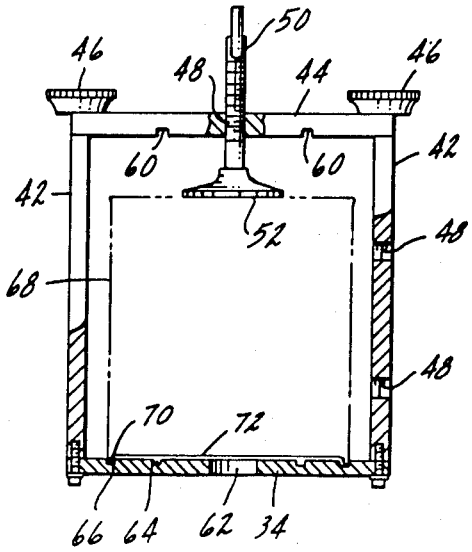
FIG. 4 is a fragmentary sectional view along the line 4—4 in FIG. 2.
Figure 5:
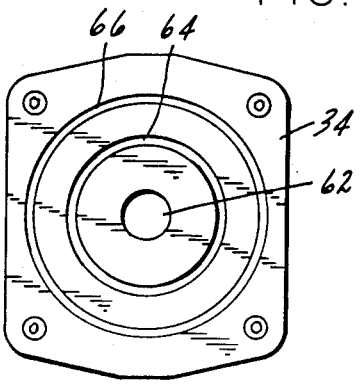
FIG. 5 is a sectional view along the line 5—5 in FIG. 2.

In the preferred embodiment the device, and particularly the spring arrangement illustrated, are designed to accommodate a standard one-gallon paint container which has a height of about 7½" and a diameter of about 6½". However, the device is designed to also accommodate smaller and other shapes of containers by arranging the containers within the envelope formed by the frame 40 in positions that provide effective weight distribution. A standard one-gallon paint container is arranged on the device in the manner best illustrated in FIG. 4. The one-gallon paint container, designated 68, is arranged on plate 34 with the projecting rim 70 at its lower end seated within groove 66. Rim 70 is sufficiently shallow so that the bottom wall 72 of the container is spaced above the top face of plate 34 so that the axial pressure applied to the lid of the container by screw 50 and clamp pad 52 is transmitted directly to the rim 70 and not the bottom wall 72 of the container.

The two slots 60 on the underside of cross bar 44 are spaced apart to engage the upwardly projecting rim 74 at the upper end of a standard one-gallon rectangular container 76 which has a width of about 4½". The upright legs 42 are dimensioned in length slightly shorter than container 76 so that the container is adapted to be clamped on plate 34 by lifting cross bar 44 to engage the rim 74 at each side of the container with the slots 60 and then tightening the threaded knobs 46.

If it is desired to shake a single standard one-quart container, the container is preferably arranged on frame 40 in the horizontally oriented position illustrated in FIG. 11. A screw 50 is threaded into the upper opening 48 in the bar 42 and the clamp pad 52 is thereafter snapped over the end of the screw. The one-quart container designated 78 is arranged horizontally between the other upright leg 42 and pad 52. The screw 50 is then advanced to engage the pad 52 with the lid of the container so that the container is clamped in place in an elevated position where it will be violently agitated.

Figure 15:
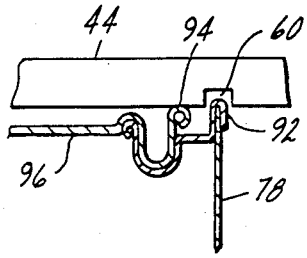
FIG. 15 is an enlarged sectional view of the circled portion of FIG. 12.

If it is desired to simultaneously shake two quart paint containers, they can be arranged on plate 34 in the manner illustrated in FIG. 12. The two containers in a vertically oriented position are stacked one upon the other with a quart container lid 80 positioned therebetween. The lid 80 is employed between the two containers so that the downward force applied to the lid of the upper container by tightening knobs 46 will be transmitted to the lid of the lower container. The slots 60 on the underside of cross bar 44 accommodate not only the parallel rim portion 74 at each side of a rectangular container 76 (FIG. 10), but are spaced apart sufficiently to overlie the rim 92 at the upper end of a one-quart container 78 when two of such containers are stacked one upon the other in the manner illustrated in FIG. 12. However, the slots 60 are shallow and sufficiently narrow so that, as shown in FIG. 15, when the cross bar 44 is urged downwardly by tightening the knobs 46, the underside of the cross bar will bear downwardly against the rim 94 of the container lid 96 rather than on the rim 92 of the container itself. This insures that both containers will remain effectively sealed while they are being shaken.

The circular grooves 64,66 in plate 34 are likewise shallow and narrow so that, if a gallon container or a quart container is placed on plate 34 in an inverted position, the clamping force will be applied to the lid of the container rather than the projecting rim around the outer edge of the container.

Figure 13:
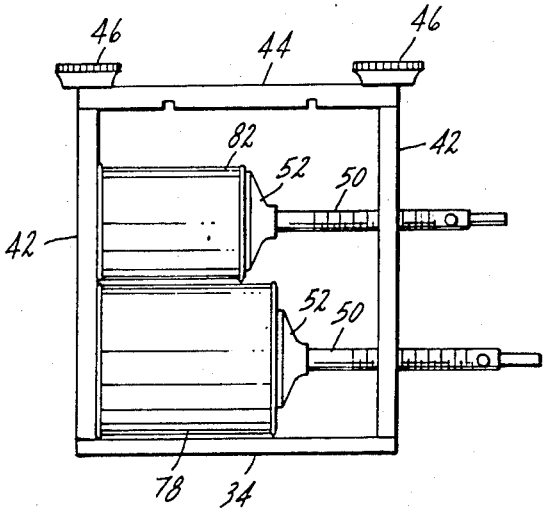
FIG. 13 illustrates the manner in which two containers, one a standard quart container and the other a standard pint container, are adapted to be clamped on the shaker.
Figure 14:
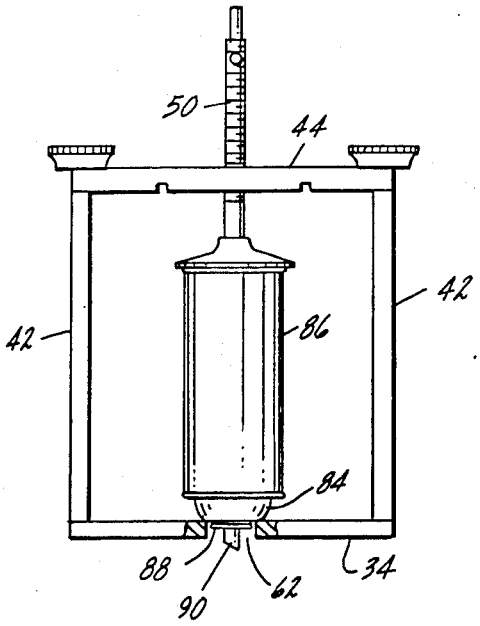
FIG. 14 illustrates the manner in which an aerosol container is adapted to be clamped on the shaker.

It should be pointed out that the two threaded openings 48 in the upright leg 42 are preferably spaced vertically and from the plate 34 so that the frame 40 will not accommodate two quart containers horizontally oriented and placed one above the other. The weight distribution of two quart containers to arranged results in an unbalanced condition which is too severe. These two openings 48 are preferably spaced vertically apart so that a quart container 78 and a pint container 82 can be arranged on plate 34 and within frame 40 in the manner illustrated in FIG. 13. A standard quart container has a diameter of about 4¼" and a pint container has a diameter of about 3⅜". Thus the lower opening 48 is spaced above plate 34 about 2⅛" and the upper opening is spaced above plate 34 about 6". When a one-quart container 78 is placed on plate 34 in a horizontally oriented position the lower clamp screw 50 and its clamp pad 52 will be coaxially aligned with the container. The one-pint container oriented horizontally and placed above the quart container 78 will be coaxially aligned with the upper screw 50 and its clamping pad 52. If it is attempted to arrange two horizontally oriented quart containers one above the other, the upper screw 50 and its clamping pad 52 will be offset downwardly substantially relative to the axis of the upper quart container and will be a visual indication to the user that the containers cannot be arranged on the shaker in this manner.

The center opening 62 in plate 34 is designed to engage with the upper rounded end 84 of a conventional aerosol spray container. The container 86 is inverted and placed on plate 34 so that its rim 88 and spout 90 project downwardly through opening 62. The container 86 is clamped on plate 34 in this position by tightening screw 50 downwardly through cross bar 44.

Figure 16:
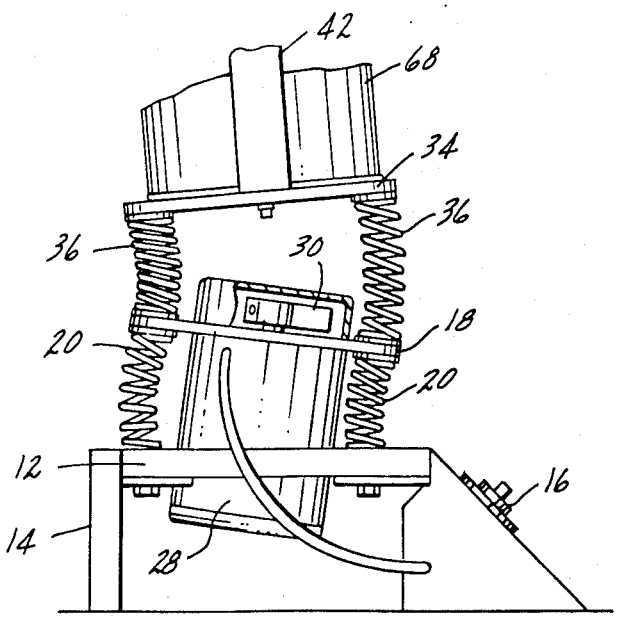
FIG. 16 is a fragmentary side elevational view illustrating in a general way the motion generated in the shaker.

The above-described device has several distinct advantages over shaking devices as heretofore constructed. These advantages appear to result primarily from the dual compression spring arrangement between base 12 and plate 18 and between plate 18 and plate 34 in combination with the arrangement of the motor 28 and the eccentric flyweight 30. This arrangement imparts to the container or containers supported on plate 34 an orbital motion in a generally horizontal plane as well as a lateral tilting motion. This type of motion is generally illustrated in FIG. 16. Careful examination of the operation of the device indicates that when the flyweight 30 is disposed at the right as shown in FIG. 16, the lower springs 20 at the right are compressed and the lower springs 20 at the left are expanded. The motor support plate 18 thus assumes a tilted position inclining downwardly to the right. Simultaneously the upper springs 36 at the right are expanded and the upper springs 36 at the left are compressed. This causes the container support plate 34 to assume a tilted position inclining downwardly and to the left. The net effect of this arrangement results in the application of a rather violent agitating motion to the container, but, in view of the fact that the lower springs 20 are more resilient than the upper springs 36, the reaction forces on plate 34 are substantially completely absorbed by springs 20 and are not transmitted to base 12. As a result, even when a filled gallon container is being shaken, there is no tendency for the shaker 10 to "creep" or "walk" on the surface on which it is supported in spite of the fact the the shaker weighs only about 27 pounds. When the container is not completely filled with paint or other emulsion, the action imparted thereto is such that air does not become entrained within the emulsion which normally occurs with paint shakers of conventional design.

A further advantage of the above-described paint shaker resides in the fact that it can be operated with a relatively small electric motor. For example, a 1/12 horsepower motor rotating at 1050 r.p.m. smoothly and easily accelerates the shaking motion of a one gallon container of paint when started and produces a very vigorous shaking action. When it is attempted to power a conventionally designed paint shaker with a motor of the same size, the motor usually stalls or, if it does not stall, it tends to overheat in a relatively short period of time. It is believed that the orbital and tilting motion imparted to the motor by the eccentric flyweight 30 actually tends to cool the motor and permit it to operate continuously without overheating.

I claim:

1. A shaker for a paint container comprising a base adapted to be positioned on a support surface, a motor support member spaced vertically from said base, resiliently flexible means extending vertically between said motor support member and said base and resiliently supporting the support member on said base, a motor mounted on said support member and having a vertically extending output shaft, a flyweight mounted eccentrically on said shaft for rotation in a generally horizontal plane, a container support member spaced vertically above said motor support member, means for fixedly securing one or more containers to be shaken on said container support member and resiliently flexible means extending vertically between said two support members and supporting the container support member on the motor support member, said resiliently flexible means being resiliently flexible both vertically and laterally, said rotating flyweight laterally tilting said motor support member in the direction of rotation and simultaneously imparting a violent orbital and lateral motion to the container and the container support member whereby, when a liquid filled container is secured on said container support member, the motor and rotating eccentric flyweight, acting through said motor support plate and the second-mentioned resilient means, generate forces which impart a violet orbital and lateral motion to the container and the first-mentioned resilient means substantially absorb the resultant forces on the motor support plate and prevent them from being transmitted to said base.

2. A shaker as called for in claim 1 wherein said first and second mentioned resilient means comprise springs.

3. A shaker as called for in claim 2 wherein said second-mentioned resilient means comprises compression springs.

4. A shaker as called for in claim 2 wherein said spring comprise compression springs.

5. A shaker as called for in claim 2 wherein said first and second mentioned resilient means each comprise a plurality of compression springs.

6. A shaker as called for in claim 1 wherein said motor support member is disposed above said base and the motor depends therefrom.

7. A shaker as called for in claim 6 wherein said eccentric flyweight is disposed at the upper end of said motor.

8. A shaker as called for in claim 7 wherein the eccentric flyweight is disposed above the motor support member.

9. A shaker as called for in claim 1 wherein said base comprises a member for supporting the first-mentioned resilient means and including a plurality of legs extending downwardly and outwardly from the periphery of said last-mentioned support member.

10. A shaker as called for in claim 1 wherein said means for securing a container to the container support member comprises a generally inverted U-shaped frame having a pair of upright legs connected at their upper ends by a cross bar and including means for clamping a container within said frame.

11. A shaker as called for in claim 10 wherein said clamping means comprises a screw clamp adapted to be threaded vertically through said cross bar and having a pad at its lower end adapted to bear against the upper end of a container on said container support.

12. A shaker as called for in claim 10 wherein said cross bar is vertically adjustable at the upper ends of said upright legs for clamping against the upper end of a container on said container support.

13. A shaker as called for in claim 10 wherein said clamp means comprises a clamp screw adapted to be threaded horizontally through one of said legs and having a pad at its inner end adapted to bear with clamping pressure against one end of a container disposed horizontally between said legs.

14. A shaker as called for in claim 10 wherein said clamp means comprises a pair of vertically spaced threaded openings extending horizontally through said legs, said openings being adapted to receive a clamp screw having a clamp pad at its inner end for clamping a pair of horizontally disposed containers, one above the other, between said legs.

15. A shaker as called for in claim 11, 12, 13 or 14 wherein the pad is releasably secured to the screw to permit quick and easy assembly and disassembly thereof with the screw.

16. A shaker as called for in claim 14 wherein said threaded openings are spaced apart vertically a distance less than required for clamping two standard sized paint quart containers between said upright legs.

17. A shaker as called for in claim 10 wherein said container support comprises a plate having a pair of concentric circular grooves therein, one for receiving the lower rim of a standard gallon paint container and the other for receiving the lower rim of a standard quart paint container.

18. A shaker as called for in claim 10 wherein said container support comprises a plate having a central opening therein for accommodating the upper end of an aerosol spray container arranged on said plate in an inverted position.

19. A shaker for a paint container comprising a base adapted to be positioned on a support surface, a plurality of vertically extending compression springs arranged around the periphery of said base, a motor support plate connected to the upper end of said springs, a motor having a vertically extending output shaft secured to and depending from said plate, an eccentric flyweight secured to said motor shaft for rotation in a generally horizontal plane, a plurality of vertically extending compression springs having their lower ends fixedly secured to said plate, a container support plate fixedly secured to the upper ends of the last-mentioned springs and means on said last-mentioned support plate for mounting a container to be shaken thereon, said rotating flywheel laterally tilting said motor support plate in the direction of rotation by sequentially compressing each of said first-mentioned springs in a lateral direction away from said base, said rotating flyweight simultaneously imparting a violent orbital and lateral motion to said container and said container support member.

20. A shaker as called for in claim 19 wherein the first and second mentioned set of springs are axially aligned.

21. A shaker as called for in claim 19 wherein the first set of springs are more flexible than the second set of springs.

22. A shaker as called for in claim 19 wherein the springs are dimensioned such that they are compressible when subjected to the static weight of the shaker components they support.

23. A shaker as called for in claim 19 wherein the opposite ends of the springs are secured to their respective supporting member by means of spring mounts, said spring mounts being externally threaded for threaded engagement with the convolutions of the springs.

* * * * *